US010906320B2

(12) United States Patent
Wood et al.

(10) Patent No.: US 10,906,320 B2
(45) Date of Patent: Feb. 2, 2021

(54) STANDPIPE CROSSFLOW CIRCULATION

(71) Applicant: HEWLETT-PACKARD DEVELOPMENT COMPANY, L.P., Fort Collins, CO (US)

(72) Inventors: Benjamin H. Wood, San Diego, CA (US); Paul Mark Haines, Lebanon, OR (US); Angela W. Bakkom, Corvallis, OR (US); Anjan Prabhat Pattathil, Singapore (SG); Franklin D. Derryberry, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/399,982

(22) Filed: Apr. 30, 2019

(65) Prior Publication Data

US 2020/0346459 A1 Nov. 5, 2020

(51) Int. Cl.
*B41J 2/175* (2006.01)
*B41J 2/18* (2006.01)

(52) U.S. Cl.
CPC ..... *B41J 2/175* (2013.01); *B41J 2/17556* (2013.01); *B41J 2/17563* (2013.01); *B41J 2/18* (2013.01)

(58) Field of Classification Search
CPC .... B41J 2/14145; B41J 2/175; B41J 2/17556; B41J 2/17563; B41J 2/18; B41J 2202/12
See application file for complete search history.

(56) References Cited

U.S. PATENT DOCUMENTS

| | | | | |
|---|---|---|---|---|
| 5,736,739 | A * | 4/1998 | Uber | G01N 27/622 250/287 |
| 7,467,858 | B2 * | 12/2008 | Lebron | B41J 2/165 347/85 |
| 8,888,208 | B2 * | 11/2014 | Cynnan, Jr. | B41J 2/175 347/6 |
| 9,421,780 | B2 * | 8/2016 | Nishiyama | B41J 2/17566 |
| 10,124,597 | B2 * | 11/2018 | Alessi | B41J 2/17596 |
| 2012/0062627 | A1 * | 3/2012 | Nitta | B41J 2/175 347/9 |
| 2019/0001671 | A1 * | 1/2019 | Yamada | B41J 2/14024 |

* cited by examiner

*Primary Examiner* — Anh T Vo
(74) *Attorney, Agent, or Firm* — Rathe Lindenbaum LLP

(57) ABSTRACT

A fluid ejection and circulation apparatus may include a fluid ejection die, the pressure regulator, a first standpipe, a second standpipe and a crossflow passage. The pressure regulator has a fluid chamber. The first standpipe is between the fluid chamber and the fluid ejection die. The first standpipe has a first port above the fluid ejection die. The second standpipe extends alongside the first standpipe. The second standpipe has a second port above the fluid ejection die. The crossflow passage connects the first standpipe and the second standpipe.

20 Claims, 13 Drawing Sheets

STANDPIPE CROSSFLOW CIRCULATION

BACKGROUND

Fluid ejection apparatus are used to selectively eject droplets of fluid. Many fluid ejection apparatuses include a standpipe to deliver fluid to a fluid ejection die and to warehouse air or other gases that may be generated during fluid ejection.

THE BRIEF DESCRIPTION OF THE DRAWINGS

Figure 1:
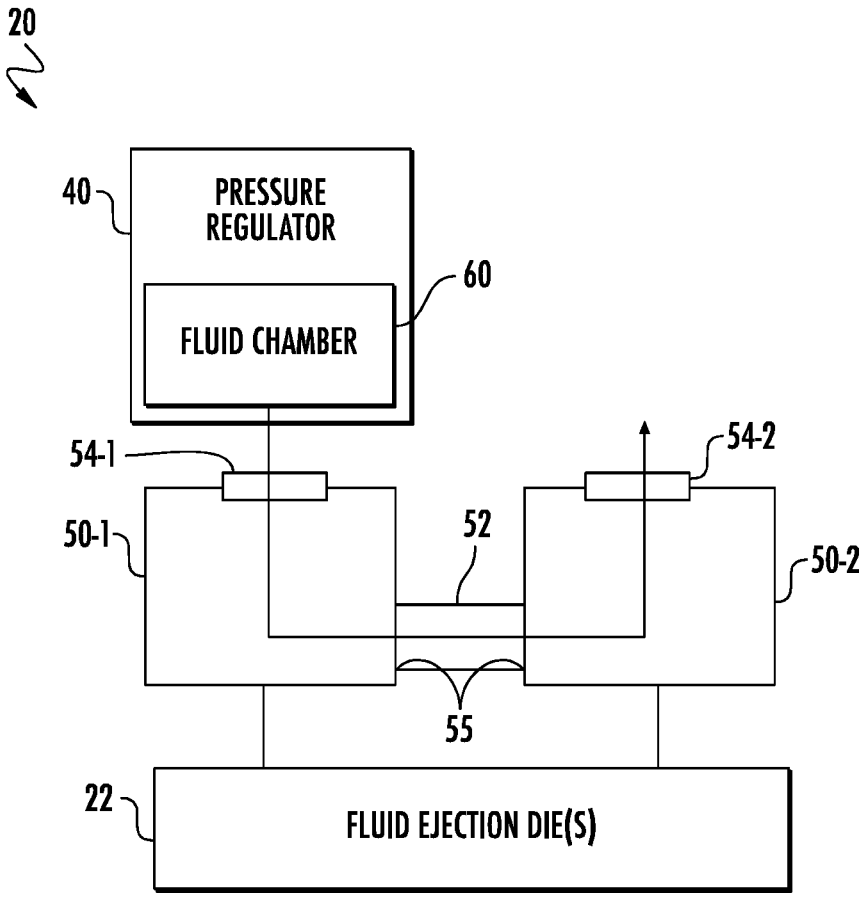
FIG. 1 is a schematic diagram illustrate portions of an example fluid ejection and circulation apparatus.

Throughout the drawings, identical reference numbers designate similar, but not necessarily identical, elements. The FIGS. are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example fluid ejection and circulation apparatus, systems and methods that use standpipes for circulating fluid to inhibit settling of fluid suspended particles. The example apparatus, systems and methods comprise a crossflow passage connecting two different standpipes that service two different portions of a fluid ejection die or multiple fluid ejection dies, wherein the crossflow passage allows fluid to flow into a first standpipe, through the crossflow passage into a second standpipe and out of the second standpipe. The formed circulation path extends within both standpipes, wherein the port of the first standpipe continues to serve as an inlet port while the port of the second standpipe, that serves as an inlet during fluid ejection, instead serves as an outlet port during such fluid circulation. Such circulation of the fluid may inhibit settling of fluid suspended particles, enhancing fluid ejection performance and facilitating use of fluids having heavier particles and/or a higher concentration of particles.

For example, in implementations where the example fluid ejection circulation apparatus and methods are used to selectively eject droplets of printing fluid, such as ink, the apparatus and methods facilitate the use of pigment-based inks having a higher concentration of pigments and/or heavier, possibly metallic, pigments. Pigment-based inks tend to be more efficient, durable and permanent as compared to dye-based inks. Such pigments may be especially beneficial in the composition of a white ink, wherein the heavier metallic pigments and/or higher concentration of such pigments provide the white ink with a greater opacity and/or brightness. With such inks, the circulation of the fluid reduces settling of the pigments, enhancing printing performance and/or prolonging life of the fluid ejection device. Without such circulation, pigment settling may block ink flow and clogged nozzles, especially during periods of storage or nonuse of printing apparatus.

The disclosed fluid ejection and circulation apparatus may provide macro recirculation. Such macro recirculation utilizes a pressure regulator that finally controls the port pressure of the fluid flowing to the fluid ejection device. Such macro recirculation continually refreshes the fluid, reducing air and particulate levels near the fluid ejection device. As a result, fluid ejection or printing reliability is enhanced.

Disclosed is an example fluid ejection and circulation apparatus may include a fluid ejection die, the pressure regulator, a first standpipe, a second standpipe and a crossflow passage. The pressure regulator has a fluid chamber. The first standpipe is between the fluid chamber and the fluid ejection die. The first standpipe has a first port above the fluid ejection die. The second standpipe extends along side the first standpipe. The second standpipe has a second port above the fluid ejection die. The crossflow passage connects the first standpipe and the second standpipe.

In one implementation, the apparatus may include a single crossflow passage connecting the first standpipe and the second standpipe. In one implementation, the two standpipes extends side-by-side generally parallel to one another, wherein each has a port at the same end of the standpipes, proximate to the same end of the fluid ejection die being serviced by the standpipes, wherein the crossflow passage is located at an opposite end of the same standpipes. In such an implementation, a U-turn circulation path is formed wherein the fluid enters the first standpipe, flows along and across the first standpipe in a first direction to the single crossflow passage, flows through the crossflow passage into the second standpipe and then flows along and across the second standpipe in a second direction opposite to the first direction to the port of the second standpipe which serves as an outlet port during such circulation.

In one implementation, the apparatus may include a single crossflow passage connecting the first standpipe and the second standpipe, wherein the two standpipes have ports at opposite ends of the standpipes. In other words, the first standpipe may have a first port proximate a first end of the a fluid ejection die being serviced by the first standpipe and the second standpipe while the second standpipe has a second port proximate a second end of the fluid ejection die being serviced by the first standpipe and the second standpipe. In some implementations, the apparatus may include multiple crossflow passages connecting the first standpipe and the second standpipe, wherein the two standpipes have ports at opposite ends of the standpipes. For purposes of this disclosure, reference to "a fluid ejection die" may refer to a single fluid ejection die or multiple fluid ejection dies, but for ease of explanation, the singular case is used to cover both.

Disclosed is an example fluid ejection and circulation apparatus that may include a fluid ejection die, a first pressure regulator comprising a first fluid chamber, a second pressure regulator comprising a second fluid chamber, a first standpipe, a second standpipe and a crossflow passage. The first standpipe is between the first fluid chamber and the fluid ejection die. The first standpipe has a first port connecting the first fluid chamber to the first standpipe proximate a first end of the fluid ejection die. The second standpipe is between the first fluid chamber and the fluid ejection die. The second standpipe has a second port connecting the second fluid chamber to the second standpipe proximate the first end of the fluid ejection die. The crossflow passage connects the first standpipe and the second standpipe proximate a second end of the fluid ejection die, wherein an imperforate wall extends between the first standpipe and the second standpipe from the first port to the crossflow passage.

Disclosed is an example fluid circulation method. The method comprises supplying fluid from a pressure regulator to a first standpipe opposite a fluid ejection die through a first port of a first standpipe and circulating the fluid from the first standpipe to a second standpipe through a crossflow passage connecting the first standpipe and the second standpipe, the second standpipe having a second port.

FIG. 1 schematically illustrates portions of an example fluid ejection and circulation apparatus 20 for the controlled ejection of fluid, wherein the fluid may be circulated within the apparatus to further mix particle suspended within the fluid to reduce settling of the particles. Apparatus 20 provide macro circulation by circulating fluid between and across two standpipes without the fluid being directed to an underlying fluid ejection die. Apparatus 20 comprises fluid ejection die(s) 22, pressure regulator 40, standpipes 50-1 and 50-2 (collectively referred to as standpipes 50) and crossflow passage 52.

Fluid ejection die(s) 22 comprises a fluid ejection die that supports multiple fluid ejection devices. A first portion of the fluid ejection devices may be directly serviced by standpipe 50-1 while a second portion of the fluid ejection devices may be serviced by standpipe 50-2. Such "servicing" refers to the supplying of fluid to the fluid ejection devices in the warehousing of air or other gases that may result from fluid ejection by the fluid ejection devices. In one implementation, fluid ejection die(s) 22 include fluid feed slots or fluid feed holes that deliver fluid being supplied by the respective standpipes 50 to fluid ejection chambers. Fluid actuators within the respective ejection chambers displace fluid to eject fluid through corresponding orifices or nozzles.

In one implementation, the fluid actuator may comprise a thermal resistor which, upon receiving electrical current, heats to a temperature above the nucleation temperature of the solution so as to vaporize a portion of the adjacent solution or fluid to create a bubble which displaces fluid through the orifice. In other implementations, the fluid actuator may comprise other forms of fluid actuators. In other implementations, the fluid actuator may comprise a fluid actuator in the form of a piezo-membrane based actuator, an electrostatic membrane actuator, mechanical/impact driven membrane actuator, a magnetostrictive drive actuator, an electrochemical actuator, and external laser actuators (that form a bubble through boiling with a laser beam), other such microdevices, or any combination thereof.

In one implementation, fluid ejection die(s) 22 may be generally formed from a silicon material upon which the fluid actuators are formed and upon which a layer of material, such as SU8 is deposited to form the fluid ejection chambers and nozzle orifices. In other implementations, the fluid ejection die(s) 22 may have different constructions or may be formed from other materials.

Pressure regulator 40 regulates the pressure of fluid being supplied through standpipes 50-1 to fluid ejection die(s) 22. Pressure regulator 40 comprises pressurized fluid chamber 60 which is fluidly connected to standpipe 50-1. In some implementations, pressure regulator 40 may comprise a compliant chamber within the fluid chamber 60 and connected to atmosphere, wherein the shape or size of the compliant chamber varies in response to changes in its inflation level which changes in response to the pressure within fluid chamber 60. In such implementations, a valve opens and closes a port through which fluid is supplied to fluid chamber 60 in response to the size or shape/inflation level of the compliant chamber. In some implementations, the size, shape or positioning of the compliant chamber or a wall of the compliant chamber is sensed, wherein a controller actuates the valve based such sensed values. In another implementation, the valve is actuated by a lever which engages the compliant chamber.

In one implementation, pressure regulator 40 maintains fluid backpressure in the fluid ejection device 24 within a narrow range below atmospheric levels in order to avoid depriming of the nozzle or nozzles (leading to drooling or fluid leaking) while optimizing fluid ejection device pressure conditions for fluid ejection or printing. During non-operational periods, this pressure is maintained statically by surface tension of fluid in the nozzle. In some implementations, the pressure regulator 40 may operate by using a formed metal spring (not shown) to apply a force to an area of flexible or compliant film or chamber that is open to the atmosphere, thereby establishing a negative internal pressure for fluid containment in the apparatus 20. A lever (not shown) on a pivot point connects the metal spring assembly to a valve (not shown) that opens and closes port 66 such that deflection of the spring can either open or close the valve by mating it to a valve seat.

During operation in a fluid ejection mode, fluid flows through standpipes 50 to fluid ejection die(s) 22. Fluid is expelled from the apparatus 20, which evacuates fluid from the pressure-controlled fluid containment system of the regulator 40. When the pressure in the regulator 40 reaches the backpressure set point established through design choices for spring force (i.e., spring constants K) and flexible film area, the valve 64 opens and allows fluid to be delivered from a pump connected to the port of the pressure regulator. Once a sufficient volume of fluid is delivered, the spring expands and closes the valve. The regulator 40 operates from fully open to fully closed (i.e., seated) positions. Positions in between the fully open and fully closed positions modulate the pressure drop through the regulator valve itself, causing the valve to act as a flow control element.

Standpipes 50 direct fluid from pressure regulator 40 to fluid ejection die(s) 22. Standpipes 50 further warehouse air or gas released from the fluid are generated during the ejection of fluid by fluid ejection die(s) 22. In one implementation, the fluid from pressure regulator 40 is first passed through a filter prior to reaching standpipe 50-1. In one implementation, standpipes 50 are directly bonded to an upper surface of fluid ejection die(s) 22. In another implementation, standpipes 50 are indirectly connected to fluid ejection die(s) 22 by an intervening structure or multiple intervening structures, such as a manifold or die carrier that further distributes the fluid to and along the fluid ejection die(s).

Standpipe 50-1 extends between fluid chamber 60 and fluid ejection die(s) 22. Standpipe 50-1 services a first portion of the fluid ejection devices of fluid ejection die (s) 22. Standpipe 50-1 comprises a port 54-1 through which fluid from fluid chamber 60 enters the interior of standpipe 50-1 when apparatus 20 is in a fluid ejection mode during which fluid is ejected by the fluid ejection devices of fluid ejection die(s) 22. In one implementation, the port 54-1 is above the fluid ejection die 22.

Standpipe 50-2 extends parallel to and alongside standpipe 50-1. Standpipe 50-services a second portion of the fluid ejection devices of fluid ejection die(s) 22. Standpipe 50-2 comprises a port 54-2. Port 54-2 may serve as a discharge port or an outlet port when apparatus 20 is in a circulation mode during which fluid is circulated through and across standpipes 50 without a majority of the volume of fluid being directed to fluid ejection die(s) 22.

Crossflow passage 52 connects the interior of standpipe 50-1 to the interior standpipe 50-2. In one implementation, crossflow passage 52 comprises an opening through an intermediate wall separating the interior of standpipe 50-1 in the interior of standpipe 50-2. In another implementation, crossflow passage 52 may comprise a tubular conduit extending between and communicating with the interiors of standpipes 50. In one implementation, crossflow passage 52 extends into close proximity with a bottom of standpipe 50 and a top of the underlying structure, whether it be the top of fluid ejection die(s) 22 or the top of and intervening structure, such as a manifold or die carrier. In one such implementation, crossflow passage 52 has a lowermost opening 55 that is spaced no greater than 2 mm from the bottom of standpipes 50 or the top of the underlying structure.

Crossflow passage 52 facilitates circulation of fluid from the interior standpipe 50-1, out of the interior standpipe 50-1 and into the interior standpipe 50-2. Crossflow passage 52 provide such cross circulation of fluid to enhance particle suspension and reduce settling of particles from the fluid. As a result, crossflow passage 52 enhances the performance of apparatus 20 and potentially lengthens the life of apparatus 20.

In one implementation, apparatus 20 may include a single crossflow passage 52 connecting the first standpipe 50-1 and the second standpipe 50-2. In one implementation, the two standpipes 50 extends side-by-side generally parallel to one another, wherein each has a port 54-1, 54-2 at the same end of the standpipes 50, proximate to the same end of the fluid ejection die(s) 22 being serviced by the standpipes 50, wherein the crossflow passage 52 is located at an opposite end of the same standpipes 50. In such an implementation, a U-turn circulation path is formed wherein the fluid enters the first standpipe 50-1, flows along and across the first standpipe 50-1 in a first direction to the single crossflow passage 52, flows through the crossflow passage 52 into the second standpipe 50-2 and then flows along and across the second standpipe 50-2 in a second direction opposite to the first direction to the port 54-2 of the second standpipe 50-2 which serves as an outlet port during such circulation.

In one implementation, the apparatus 20 may include a single crossflow passage 52 connecting the first standpipe 50-1 and the second standpipe 50-2, wherein the two standpipes 50 have ports 54-1, 54-2 at opposite ends of the standpipes 50. In other words, the first standpipe 50-1 may have a first port 54-1 proximate a first end of fluid ejection die(s) 22 being serviced by the first standpipe 50-1 and the second standpipe 50-2 while the second standpipe has a second port 54-2 proximate a second end of the fluid ejection die(s) 22 being serviced by the first standpipe 50-1 and the second standpipe 50-2. In some implementations, the apparatus 20 may include additional crossflow passages 52, wherein the multiple crossflow passages 52 connect the first standpipe 50-1 and the second standpipe 50-2, wherein the two standpipes 50 have ports 54-1, 54-2 at opposite ends of the standpipes 50.

Figure 2:
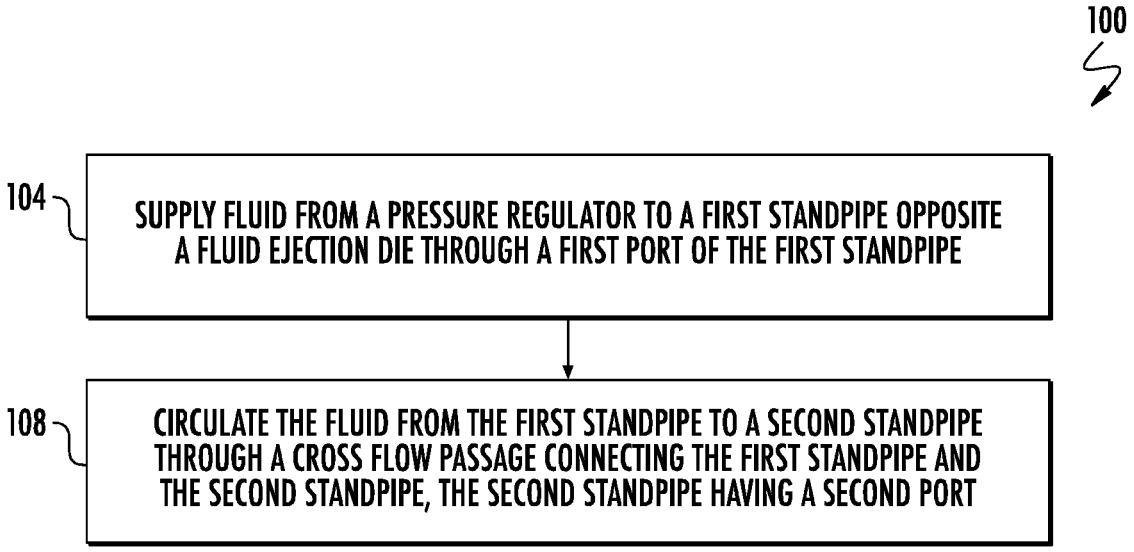
FIG. 2 is a flow diagram of an example fluid circulation method.

FIG. 2 is a flow diagram of an example fluid circulation method 100 for circulating fluid in a fluid ejection apparatus to reduce sedimentation of particles within the fluid. Method 100 reduces sedimentation to enhance the performance and/or prolong the life of the fluid ejection apparatus. Although method 100 is described in the context of being carried out by apparatus 20, it should be appreciated that method 100 may likewise be carried out with any of the apparatus and system described hereafter or with other similar apparatus and systems.

As indicated by block 104, pressure regulator 40 supplies fluid to standpipe 50-1 opposite fluid ejection die(s) through port 54-1 of standpipe 50-1. As indicated by block 108, the fluid within standpipe 50-1 is circulated to standpipe 50-2 through crossflow passage 52 which connects standpipe 50-1 to standpipe 50-2. The second standpipe 50-2 has a second port 54-2. In one implementation, the fluid is circulated through the second port away from fluid ejection die(s) 22. In one implementation, fluid is directed through port 54-2 to a fluid chamber of a second pressure regulator and out of the second pressure regulator to a fluid source for subsequent recirculation. In one implementation, the fluid from the fluid source may pumped into the pressure regulator 40 while a fluid is pulled or drawn out of the second pressure regulator and out of standpipe 50-2 through port 54-2.

Figure 3:
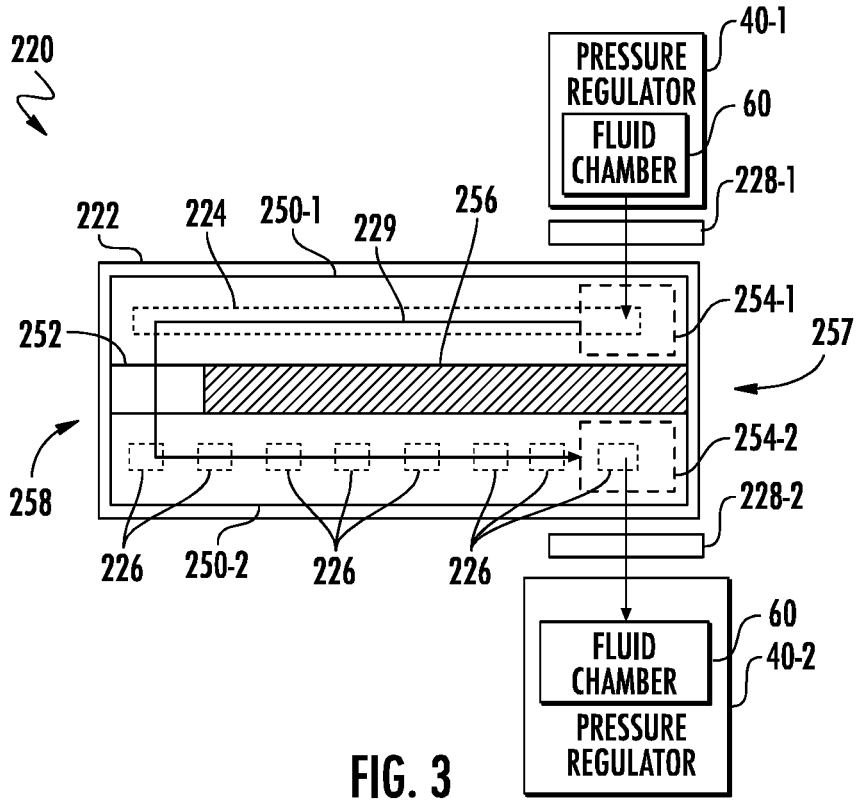
FIG. 3 is a schematic diagram illustrating portions of an example fluid ejection and circulation apparatus.

FIG. 3 schematically illustrates portions of an example fluid circulation and circulation apparatus 220. FIG. 3 illustrates a top sectional view of its standpipes and underlying fluid ejection dies while schematically illustrating its pressure regulators and filters. Similar to apparatus 20, apparatus 220 provides macro circulation by circulating fluid between and across two standpipes without the fluid being directed to an underlying fluid ejection die. Apparatus 220 comprises fluid ejection die 222, filters 228-1, 228-2 (collectively referred to as filters 228), pressure regulators 40-1, 40-2 standpipe 250-1, 250-2 (collectively referred to as standpipes 250) and crossflow passage 252.

Fluid ejection die 222 is similar to fluid ejection die(s) 22 described above. Fluid ejection die 222 is illustrated in more detail in FIG. 3 as specifically including a fluid supply slot 224 and a series of fluid feed holes 226 which extend through die 222 in which supply fluid to associated fluid ejection devices (described above). In the example illustrated, fluid supply slot 224 is serviced by standpipe 250-1 while fluid feed hole 226 are serviced by standpipe 250-2. Such fluid passages through die 222 are illustrated as different examples by which fluid may be passed through die 222. It should be appreciated that die 222 may replace fluid feed holes 226 with another slot similar to slot 224 or may replace slot 224 with fluid feed holes similar to fluid feed holes 226. The relative size, spacing and extent of slot 224 and fluid feed holes 226 may be varied depending upon such factors as the density of the fluid ejection device is provided in die 222. In some implementations, an additional die carrier or manifold may be positioned between fluid ejection die 222 and standpipes 250, wherein the die carrier or manifold delivers fluid from the standpipes 250 to the slots 224 and/or fluid feed holes 226. In some implementations, the intermediate die carrier manifold may itself include corresponding slots or fluid feed holes.

Filters 228 comprise porous structures through which fluid is passed and filtered. Filters 228 remove contaminants or other unwanted particles from the fluid being supplied to fluid ejection die 222. In the example illustrated, filter 228-1 is supported or sandwiched between fluid chamber 60 of pressure regulator 40-1 and port 254-1 of standpipe 250-1. Filter 228-2 is sandwiched between fluid chamber 60 of pressure regulator 40-2 and port 254-2 of standpipe 250-2.

Pressure regulators 40-1 and 40-2 are each similar pressure regulator 40 described above. Each of pressure regulators 40 comprises a fluid chamber 60. Fluid chamber 60 of pressure regulator 40-1 is directly or indirectly connected to port 254-1 of standpipe 250-1. Fluid chamber 60 of pressure regulator 40-2 is directly or indirectly connected to port 254-2 of standpipe 250-2. As described above, pressure regulars 40 may include additional components which control the pressure of fluid within fluid chamber 60 in which further control the pressure the fluid being supplied to the fluid ejection devices of fluid ejection die 222.

Standpipes 250 are similar to standpipes 50 described above. In the example illustrated, standpipes 250 extend alongside one another, generally parallel to one another. Standpipes 250 are separated by an intervening imperforate barrier or wall 256. Standpipe 250-1 has a port 254-1 connected to fluid chamber 60 of pressure regulator 40-1. Standpipe 250-2 has a port 254-2 connected to fluid chamber 60 of pressure regulator 40-2.

Crossflow passage 252 connects the interiors of standpipes 250-1 and 250-2. In the example illustrated, crossflow passage 252 comprises an opening within wall 256 between standpipes 250-1 and 250-2. In the example illustrated, ports 254-1, 2 54-2 at the same end of the standpipes 250, proximate to the same end 257 of the fluid ejection die 222 being serviced by the standpipes 250, wherein the crossflow passage 252 is located at an opposite end 258 of the same standpipes 250 and a fluid ejection die 222. In such an implementation, a U-turn circulation path is formed.

During a fluid ejection mode, fluid is ejected by the fluid ejection devices of fluid ejection die 222. In one implementation, pressure regular 40-1 supplies fluid through filter 228-1 to standpipe 250-1 which further delivers a fluid through slot 224 to the fluid ejection devices of die 222 that are serviced by slot 224. Similarly, pressure regulator 40-2 supplies fluid through filter 228-2 to standpipe 250-2 which further delivers a fluid through fluid feed holes 226 to the fluid ejection devices of die 222 that are serviced by fluid feed holes 226. In the fluid ejection mode, ports 254-1 and 254-2 both serve as inlet ports by which fluid is supplied into standpipes 250.

During a fluid circulation mode, fluid is not ejected by fluid ejection devices, but is instead circulated into and out of standpipes 250 using the U-turn circulation path. As indicated by arrow 259, fluid is pumped to or delivered to the first standpipe 250-1 from pressure regulator 40-1 and through port 254-1. The fluid then flows along and across the first standpipe 250-1 in a first direction to the crossflow passage 252. Thereafter, the fluid flows through the crossflow passage 252 into the second standpipe 250-2. Once in the standpipe 250-2, the fluid further flows along and across the second standpipe 250-2 in a second direction opposite to the first direction to the port 254-2 of the second standpipe 250-2. Lastly, the fluid flows through port 254-2 out of standpipe 250-2. In the example illustrated, the fluid discharged through port 254-2 flows across filter 228-2 and into fluid chamber 60 of pressure regular 40-2. The fluid may then be discharged from fluid chamber 60 of pressure regulator 40-2. In one implementation, the fluid is pulled or drawn by pumping fluid from chamber 60 of pressure regulator 40-2, where it is available for subsequent recirculation through apparatus 220. During such circulation along the path indicated by arrows 259, fluid is not being ejected by fluid ejection die 222 such that a majority, if not substantially all, of the fluid flowing through standpipes 250 leaves standpipe 250-2 through port 254-2.

In one implementation, apparatus 220 is further operable in a reverse flow circulation mode. In the reverse flow circulation mode, fluid is directed through and along standpipes 250 and an opposite direction to the direction indicated by arrows 259. In particular, fluid is pumped to or delivered to the standpipe 250-2 from pressure regulator 40-2 and through port 254-2. The fluid then flows along and across the first standpipe 250-2 in a first direction to the crossflow passage 252. Thereafter, the fluid flows through the crossflow passage 252 into the standpipe 250-1. Once in the standpipe 250-1, the fluid further flows along and across the second standpipe 250-1 in a second direction opposite to the first direction to the port 254-1 of the second standpipe 520-1. Lastly, the fluid flows through port 254-1 out of standpipe 250-1. In the example illustrated, the fluid discharged through port 254-1 flows across filter 228-1 and into fluid chamber 60 of pressure regular 40-1. The fluid may then be discharged from fluid chamber 60 of pressure regulator 40-1. In one implementation, the fluid is pulled or drawn by a pump or vacuum from fluid chamber 60 of pressure regulator 40-1, where it is available for subsequent recirculation through apparatus 220. During such reverse direction fluid circulation, fluid is not being ejected by fluid ejection die 222 such that a majority, if not substantially all, of the fluid flowing through standpipes 250 leaves standpipe 250-1 through port 254-1.

Figure 4:
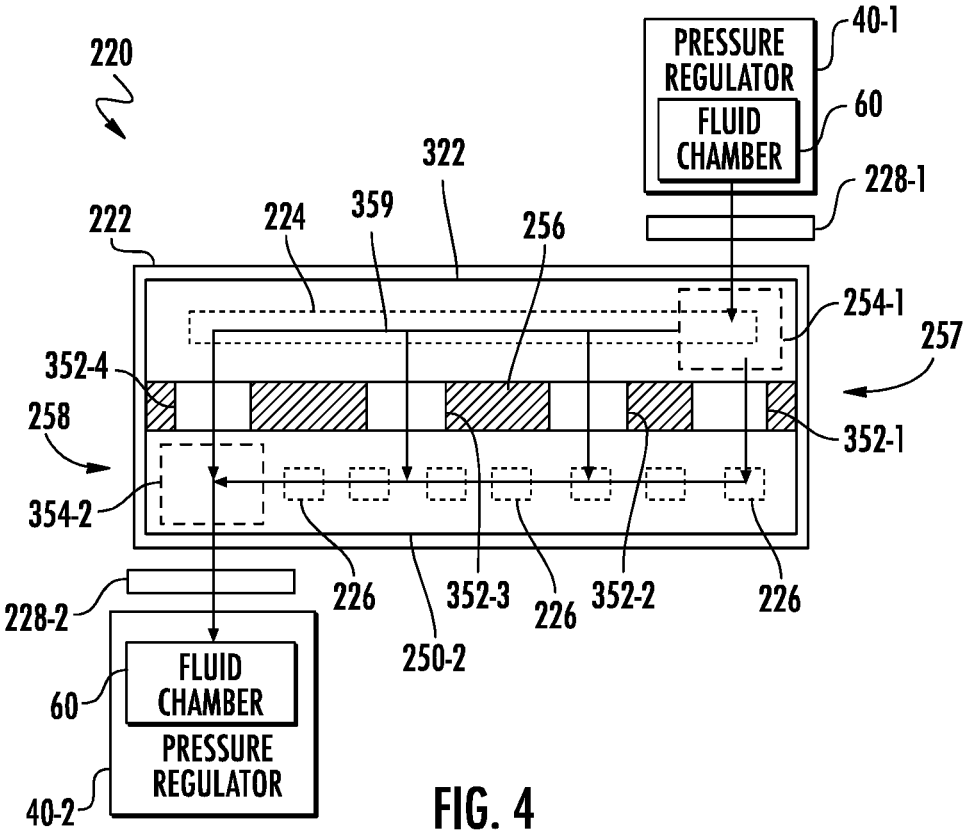
FIG. 4 is a schematic diagram illustrating portions of an example fluid ejection and circulation apparatus.

FIG. 4 schematically illustrates portions of an example fluid circulation and circulation apparatus 320. FIG. 4 illustrates a top sectional view of its standpipes and underlying fluid ejection dies while schematically illustrating its pressure regulators and filters. Similar apparatus 20 and 220, apparatus 320 provides macro circulation by circulating fluid between and across two standpipes without the fluid being directed to an underlying fluid ejection die. Apparatus 320 is similar to apparatus 220 except that apparatus 320 comprises crossflow passages 352-1, 352-2, 352-3 and 352-4 (collectively referred to as crossflow passages 352) and fluid port 354-2 in place of crossflow passage 252 and port 254-2, respectively. Those remaining components or structures of apparatus 320 which correspond to components or structures of apparatus 220 are numbered similarly.

Crossflow passages 352 extend through wall 256, connecting the interior of standpipe 250-1 to the interior standpipe 250-2. Crossflow passages 350 to allow circulate between and along standpipes 250. In the example illustrated, crossflow passages 352-4 and 352-1 extend on opposite sides of an axial midpoint of wall 256. Although apparatus 320 is illustrated as comprising the four illustrated crossflow passages 352, in other implementations, apparatus 320 may include a greater or fewer of such crossflow passages. Moreover, the density or spacing of the crop flow passages 352, the positioning of the crossflow passages 352 along the length of wall 256 and/or the size/shape of the individual crossflow passages 352 may vary depending upon the particular characteristics of fluid ejection die 222, the cross-sectional area and length of standpipes 250, the rate at which fluid is moved through apparatus 220 and/or the characteristics of the fluid itself.

Port 354-2 is similar to port 254-2 in that port 354-2 connects the interior of the standpipe 250-2 to the fluid chamber 60 of pressure regulator 40-2. In the example illustrated, filter 228-2 extends between port 354-2 and fluid chamber 60. Unlike port 254-2, port 354-2 is located proximate to an opposite end of standpipes 250, proximate to an opposite end of the fluid ejection die 222 as port 254-1. Because port 354-2 is located proximate to end 258 while port 254-1 is located proximate to end 257, fluid circulation along at least a majority if not substantially an entire length of standpipes 250 is promoted. Such circulation agitates or mixes particles to reduce particle sedimentation.

During a fluid ejection mode, fluid is ejected by the fluid ejection devices of fluid ejection die 222. In one up limitation, pressure regular 40-1 supplies fluid through filter 228-1 to standpipe 250-1 which further delivers a fluid through slot 224 to the fluid ejection devices of die 222 that are serviced by slot 224. Similarly, pressure regulator 40-2 supplies fluid through filter 228-2 to standpipe 250-2 which further delivers a fluid through fluid feed holes 226 to the fluid ejection devices of die 222 that are serviced by fluid feed holes 226. In the fluid ejection mode, ports 254-1 and 354-2 both serve as inlet ports by which fluid is supplied into standpipes 250.

During a fluid circulation mode, fluid is not ejected by fluid ejection devices, but is instead circulated into and out of standpipes 250 using crossflow passages 352. As indicated by arrow 359, fluid is pumped to or delivered to the first standpipe 250-1 from pressure regulator 40-1 and through port 254-1. The fluid then flows along and across the first standpipe 250-1 with a portion further flowing through crossflow passages 352 into standpipe 250-2. Once in the standpipe 250-2, the fluid further flows along and across the second standpipe 250-2 in the same direction to the port 354-2 of the second standpipe 250-2. Lastly, the fluid flows through port 354-2 out of standpipe 250-2. In the example illustrated, the fluid discharged through port 354-2 flows across filter 228-2 and into fluid chamber 60 of pressure regular 40-2. The fluid may then be discharged from fluid chamber 60 of pressure regulator 40-2. In one implementation, the fluid is pulled or drawn by a pumper vacuum from fluid chamber 60 of pressure regulator 40-2, where it is available for subsequent recirculation through apparatus 320. During such circulation along the path indicated by arrows 259, fluid is not being ejected by fluid ejection die 222 such that a majority, if not substantially all, of the fluid flowing through standpipes 250 leaves standpipe 250-2 through port 354-2.

In one implementation, apparatus 320 is further operable in a reverse flow circulation mode. In the reverse flow circulation mode, fluid is directed through and along standpipes 250 in an opposite direction to the direction indicated by arrows 359. In particular, fluid is pumped to or delivered to the standpipe 250-2 from pressure regulator 40-2 and through port 354-2. The fluid then flows along and across the standpipe 250-2 with a portion further flowing through crossflow passages 352 into standpipe 250-1. Once in the standpipe 250-1, the fluid further flows along and across the standpipe 250-1 in the same direction to the port 254-1 of the standpipe 250-1. Lastly, the fluid flows through port 254-1 out of standpipe 250-1. In the example illustrated, the fluid discharged through port 254-1 flows across filter 228-1 and into fluid chamber 60 of pressure regular 40-1. The fluid may then be discharged from fluid chamber 60 of pressure regulator 40-1. In one implementation, the fluid is pulled or drawn by a pump or vacuum from fluid chamber 60 of pressure regulator 40-1, where it is available for subsequent recirculation through apparatus 320. During such circulation, fluid is not being ejected by fluid ejection die 222 such that a majority, if not substantially all, of the fluid flowing through standpipes 250 leaves standpipe 250-1 through port 254-1.

Figure 5A:
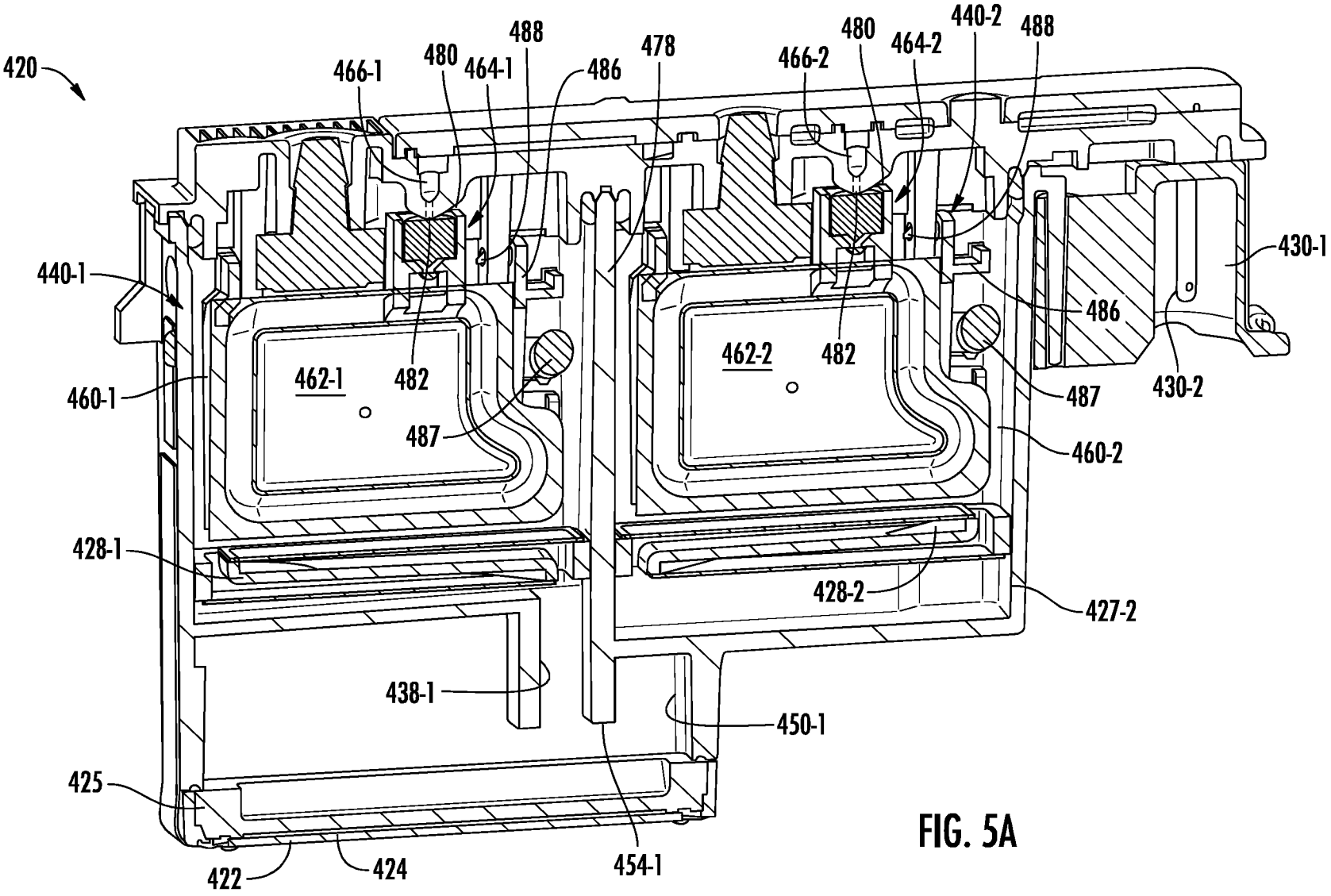
FIG. 5A is a sectional view illustrating portions of an example fluid ejection and circulation apparatus.
Figure 5B:
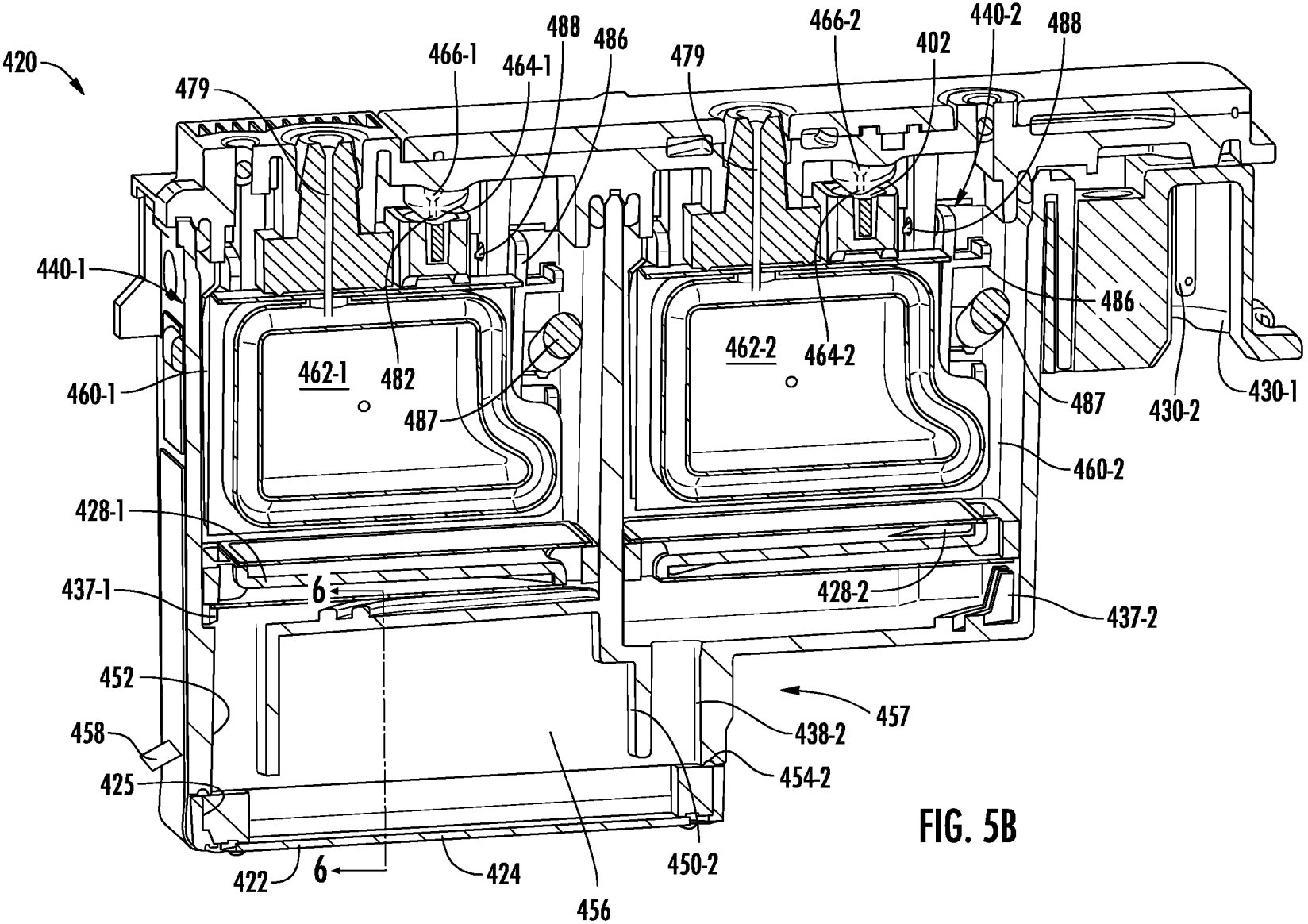
FIG. 5B is a sectional view illustrating portions of an example fluid ejection and circulation apparatus.

FIGS. 5A and 5B are sectional views illustrating portions of an example fluid ejection and circulation apparatus 420. Apparatus 420 may be in the form of a print or fluid ejection module which may be a removable and replaceable component of a larger overall fluid ejection system. Apparatus 420 comprises fluid ejection die 422, providing an array of fluid ejection devices 424, die carrier 425, filter chambers 427-1, 427-2 (collectively referred to as filter chambers 427), filters 428-1, 428-2 (collectively referred to as filters 428), fluid needles 430-1, 430-2 (collectively referred to as fluid needles 430), pressure regulators 440-1, 440-2 (collectively referred to as pressure regulators 440), standpipes 450-1, 450-2 (collectively referred to as standpipes 450) and crossflow passage 452.

Figure 6:
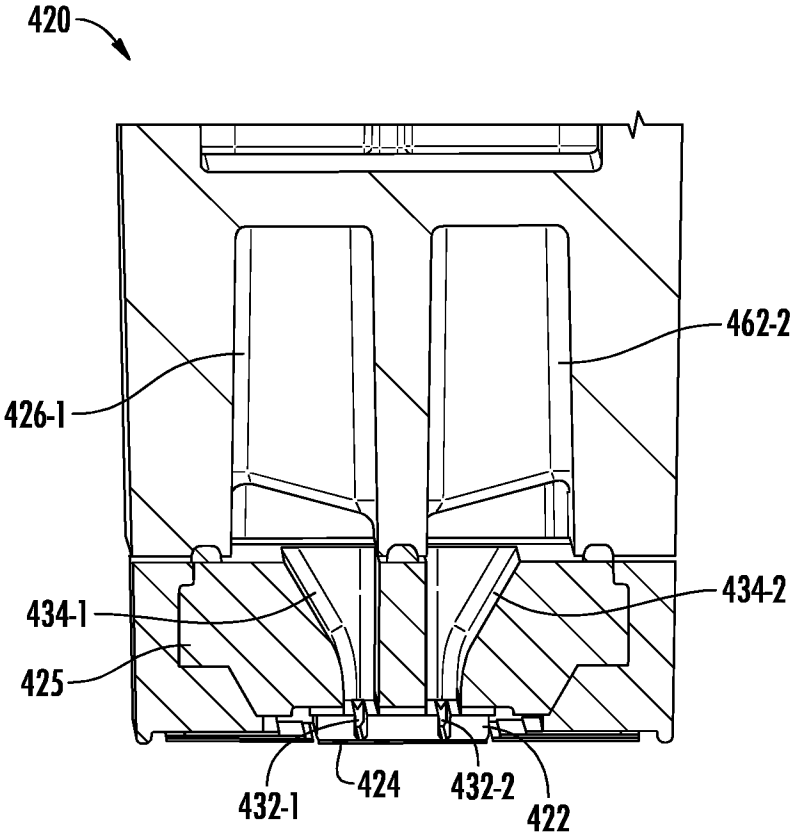
FIG. 6 is a sectional view of the fluid ejection and circulation apparatus of FIG. 5B taken along line 6-6.

FIG. 6 is a sectional view illustrating fluid ejection die 422, die carrier 425 and standpipes 450 in greater detail. Fluid ejection die 422 comprises a fluid ejection die supporting a series or array of fluid ejection devices 424 (such as the fluid ejection devices described above). In the example illustrated, fluid ejection die 422 comprises a pair of slots or a series of fluid feed holes 432-1, 432-2 through which fluid is supplied to the individual fluid ejection devices 424.

Die carrier 425 is bonded to die 422 and supports die 422 below standpipes 450-1 and 450-2. In one implementation, the material forming standpipes 450 as a first coefficient of thermal expansion, the material forming die 422 has a second coefficient of thermal expansion and the material forming die carrier 425 has a third coefficient of thermal expansion between that of die 422 and the material standpipes 450. In one implementation, die 422 is formed from silicon whereas the material standpipes 450 is formed from a polymer in the material die carrier 425 is formed from a ceramic. As shown by FIG. 6, die carrier 425 includes slots 434-1 and 434-2 which supply fluid from standpipes 450-1 and 450-2 to fluid feed holes 432-1 and 422-2, respectively.

Filters 428 are similar to filters 28 described above. Filter 428-1 filters the fluid supplied from pressure regulator 440-1 to filter chamber 437-1 and ultimately to fluid feed holes 432-1 shown in FIG. 6. Filter 428-2 filters fluid supplied from pressure regulator 440-2 to filter chamber 437-2 and ultimately to fluid feed holes 432-2 as shown in FIG. 6. In the example illustrated, filters 428-1 and 428-2 form the floor of the respective fluid chambers of pressure regulator 440-1 and 440-2.

Pressure regulators 440-1 and 440-2 are substantially identical to one another. Pressure regulators 440-1, 440-2 comprises fluid chambers 460-1, 460-2, compliant chambers 462-1, 462-2, valve 464-1, 464-2. Fluid chambers 460-1, 460-2 contain compliant chambers 462-1, 462-2, respectively. Fluid chambers 460-1, 460-2 comprises ports 466-1, 466-2, respectively, through which fluid may flow into and out of the respective fluid chambers 460.

Compliant chambers 462 each comprise a flexible membrane, pouch, bag or other structure which may change in shape and volume in response to pressure changes within the respective fluid chambers 460. In one implementation, each of compliant chambers 462 may comprise a flexible bag having an interior connected to atmosphere by an atmospheric port 479.

Valves 464 each comprise a valve mechanism that selectively opens and closes its respective port 466-1, 466-2 in response to or based upon the inflation level, shape or size of the associated compliant chamber 462 which is itself dependent upon the fluid pressure level within interior of the associated fluid chamber 460. As shown by FIGS. 5A and 5B, each of ports 466 passes through a crown 480 against which a valve seat 482 may bear against to seal the respective port 466. In the example illustrated, the valve seat 482 of each of pressure regulators 440 pivots between port closing or sealing position and a port opening position by use of a lever that engages compliant chamber 462. In one implementation, the valve seat 482 is formed from a resilient a rubber-like material. Examples of such materials include silicon rubbers, fluoro silicate elastomers, or blends thereof.

Figure 7:
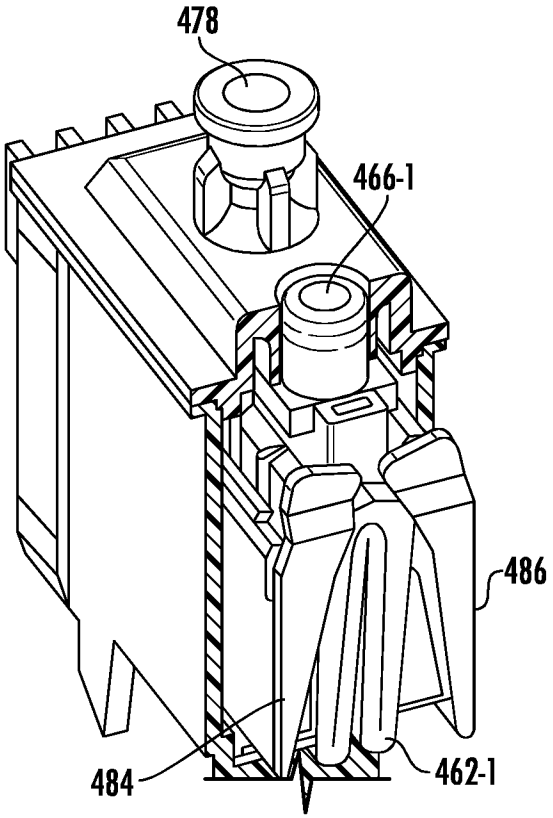
FIG. 7 is a fragmentary sectional view of a portion of an example pressure regulator of the apparatus of FIGS. 5A and 5B.
Figure 9:
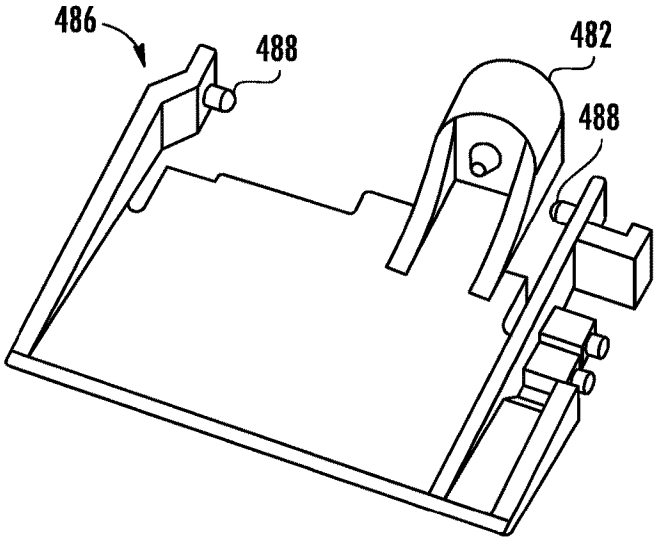
FIG. 9 is a perspective view illustrating an example lever and valve seat of the pressure regulator of FIG. 7.
Figure 8:
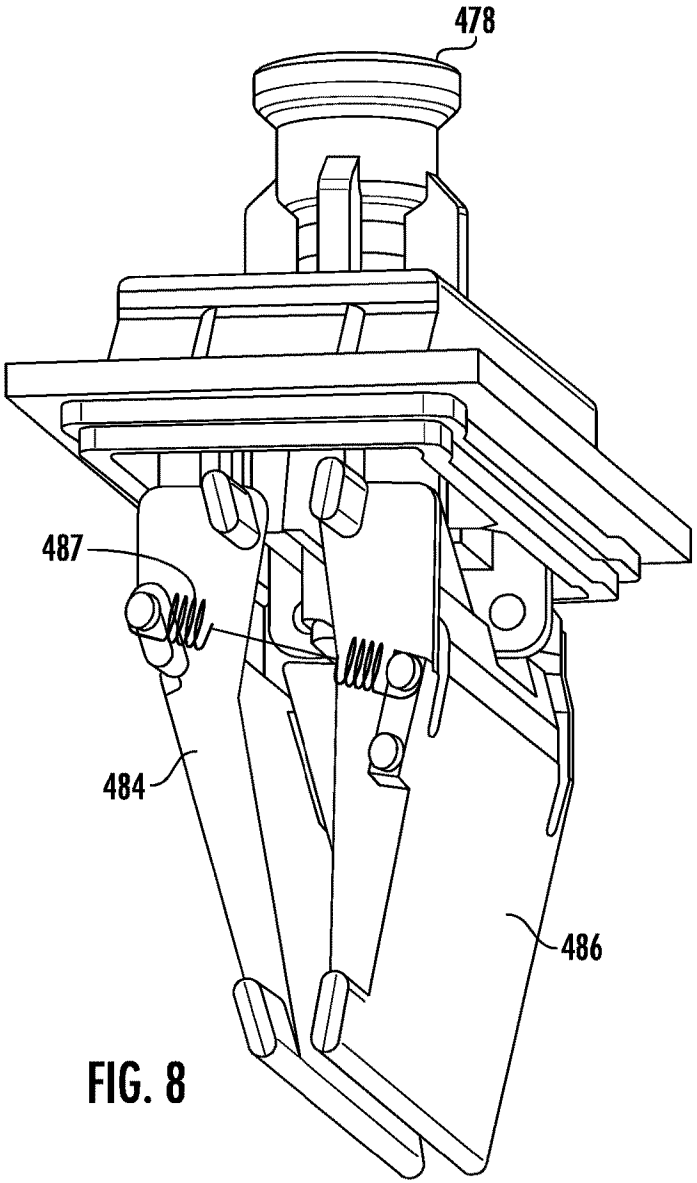
FIG. 8 is a perspective view illustrating portions of the example pressure regulator of FIG. 7.

FIGS. 7-9 illustrate portions of pressure regulator 440-1 in more detail. As noted above, pressure regular 440-2 is substantially similar to pressure regulator 440-1. As shown by FIG. 7, compliant chamber 462-1 may be in the form of an inflatable bag captured between a pair of levers 484, 486. Levers 484, 486 are resiliently biased towards one another and against compliant chamber 462-1 by a tension spring 487 (shown in FIG. 8). As shown by FIG. 9, lever 486 further supports valve seat 482. Lever 486 pivots about axles 488 which are pivotally received within the body of apparatus 420 is shown by FIGS. 5A and 5B. Depending upon the inflation level of compliant chamber 462-1, valve seat 482 may be pivoted into sealing engagement with crown 480 or out of sealing engagement with respect to crown 480.

Standpipes 450 extend side-by-side parallel to one another above die carrier 425 and above ejection die 422. Standpipes 450 receive fluid from filter chambers 427-1, 427-2, respectively, after the fluid has passed through filters 428-1 and 428-2, respectively (shown in FIGS. 5A and 5B). In particular, standpipe 450-1 receives fluid from filter chamber 427-1 through a fluid conduit 438-1 terminating at a port 454-1 as seen in FIG. 5A. Standpipe 450-2 receives fluid from filter chamber 427-2 through a fluid conduit 438-2 terminating at a port 454-2 as seen in FIG. 5B. Standpipes 450-1 and 450-2 are separated by an intervening wall 456.

Crossflow passage 452 connects the interiors of standpipes 450-1 and 450-2. In the example illustrated, crossflow passage 452 comprises an opening within wall 456 between standpipes 450-1 and 450-2. In the example illustrated, ports 454-1, 454-2 are proximate the same end of the standpipes 450, proximate to the same end 457 of the fluid ejection die 422 being serviced by the standpipes 450, wherein the crossflow passage 452 is located at an opposite end 458 of the same standpipes 450 and a fluid ejection die 422. In such an implementation, a U-turn circulation path is formed.

Figure 10:
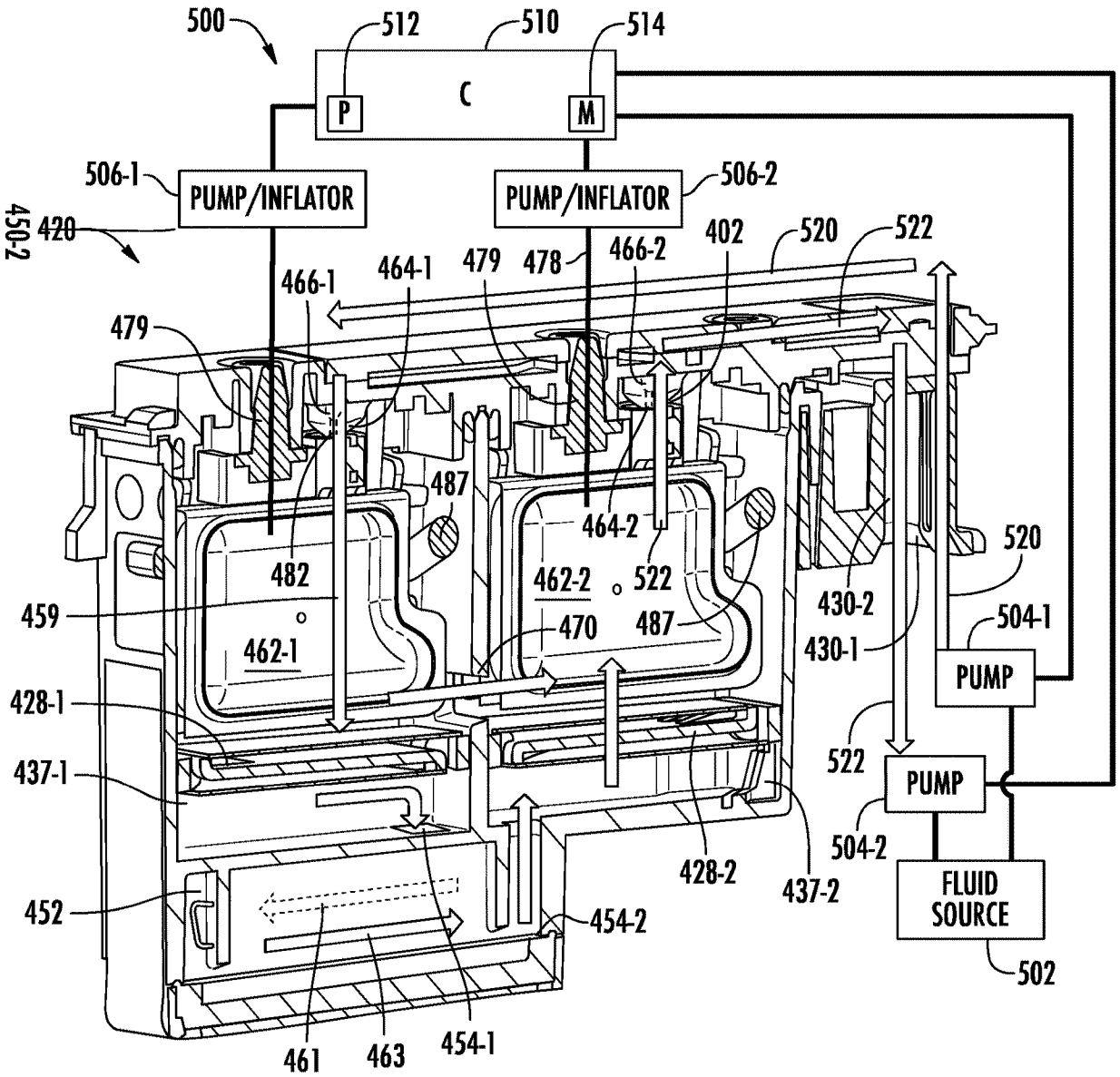
FIG. 10 is a sectional view of the fluid ejection and circulation apparatus of FIGS. 5A and 5B as part of a fluid ejection and circulation system operating in a circulation mode.

FIG. 10 illustrates fluid ejection and circulation apparatus 420 provided as part of a larger fluid ejection and circulation system 500. In addition to apparatus 420, system 500 comprises external fluid source 502, fluid pumps 504-1, 504-2 (collectively referred to as fluid pumps 504), pumps/inflators 506-1, 506-2 (collectively referred to as pumps/inflators 506) and controller 510. External fluid source 502 serves as a reservoir containing fluid to be supplied to each of pressure regulators 440 and ultimately to fluid ejection die 422. Pumps 504 selectively pump fluid from fluid source 502 to fluid chambers 460-1, 460-2 or pull fluid from fluid chambers 460-1, 460-2, respectively, back into fluid source 502. Pumps/inflators 506 are selectively connectable to their respective compliant chambers 462-1 and 462-2. Pump/inflators 506 close off the interior of their respective compliant chambers from atmosphere and controllably inflate their respective compliant chambers 462 to open the respective valves 464-1 and 464-2.

Controller 510 actuates system 500 and apparatus 420 between the fluid ejection mode or state in a fluid circulation mode or state. Controller 510 may comprise a processing unit 512 that follows instructions contained in a non-transitory computer-readable medium 514. Following instructions contained in medium 514, processing unit 512 may output control signals to control the operation of pumps 504 and pump/inflators 506 to actuate apparatus 420 between the fluid ejection mode and the fluid circulation mode.

In the fluid ejection mode, each of the pressure regulators 440 maintains fluid backpressure in the fluid ejection die 422 within a narrow range below atmospheric levels in order to avoid depriming of the nozzles are ejection orifices (leading to drooling or fluid leaking) while optimizing fluid ejection device pressure conditions for fluid ejection or printing. During non-operational periods, this pressure is maintained statically by surface tension of fluid in the ejection orifices. The pressure regulators 440 operate by using spring 487 to apply a force to an area of their respective compliant chambers 462 which are open to the atmosphere through atmospheric ports 479, thereby establishing a negative internal pressure for fluid containment in the apparatus. Lever 486 pivots in response to inflation or deflation of the associated compliant chamber 462 to seat or unseat valve seat 482 with respect to the associated crown 480 to seal or open the respective port 466.

During ejection of fluid, fluid is expelled by fluid ejection die 422 which evacuates fluid from the pressure-controlled fluid containment system of the regulators 440. When the pressure in the respective regulator 440 reaches the backpressure set point established through design choices for spring force (i.e., spring constants K) and flexible film area, the valve seat 482 opens and allows fluid to be delivered from pumps 504-1, 504-2 connected to the port 466-1 and port 466-2, respectively. The regulators 440 each operate from fully open to fully closed (i.e., seated) positions. Positions in between the fully open and fully closed positions modulate the pressure drop through the regulator valve itself, causing the valve mechanism 464 to act as a flow control element.

In the circulation mode, fluid is not ejected from apparatus 420. FIG. 10 illustrates apparatus 420 in a fluid circulation mode in which fluid is not ejected by fluid ejection devices, but is instead circulated into and out of standpipes 450 using the U-turn circulation path. In such a circulation mode, controller 510 causes pump 504-1 to supply fluid from fluid source 502 through internal flow passages and through port 466-1 into fluid chamber 460-1 as indicated by arrows 520. Controller 510 causes pump/inflators 506-2 to disconnect port 479 of compliant chamber 462-2 from atmosphere and to alternatively inflate compliant chamber 462-2 through port 479 to a point such that valve seat 482 is pivoted out of sealing engagement with crown 480 about port 466-2, opening port 466-2. Controller 510 further output control signals causing pump 504-2 to apply a vacuum pressure to pull or draw fluid from fluid chamber 460-2 through the opened port 466-2 and back into fluid source 502 as indicated by arrows 522.

Figure 11:
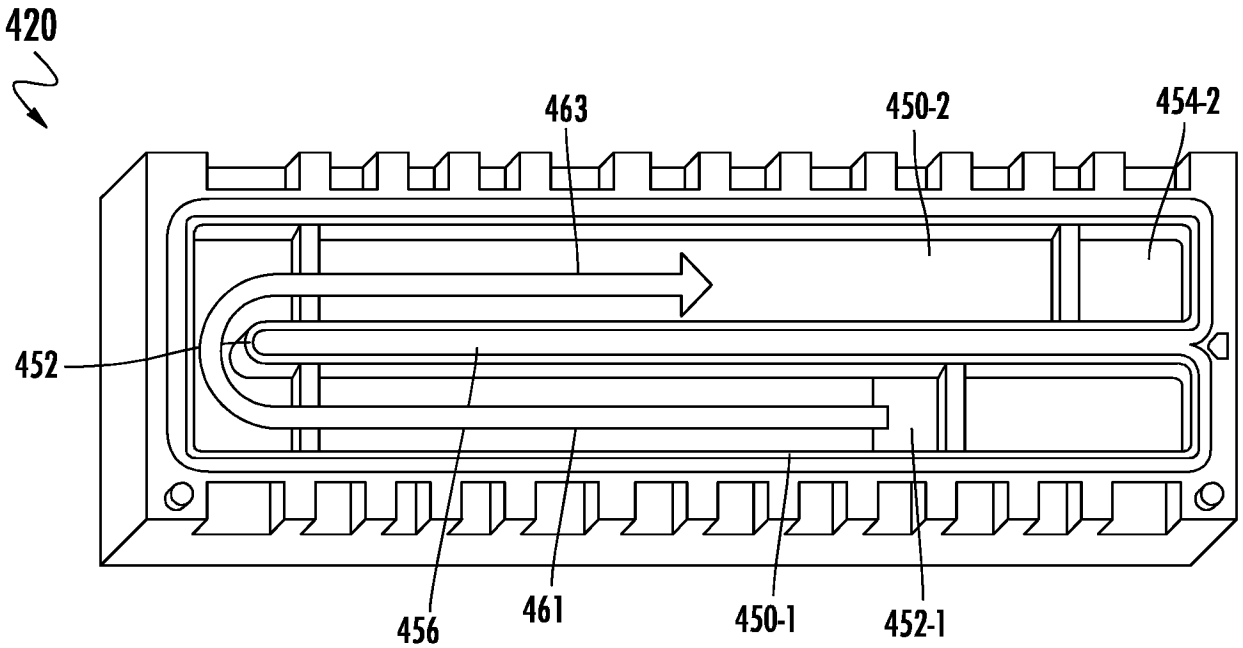
FIG. 11 is a bottom view of a portion of the fluid ejection and circulation apparatus of FIG. 10.

As indicated by arrows 459, the fluid circulation path is formed wherein fluid is pumped to or delivered from fluid source 502, through needle 430-1 to the first standpipe 450-1 from pressure regulator 440-1 and through port 454-1 into standpipe 450-1. As shown by FIGS. 10 and 11, the fluid then flows along and across the first standpipe 450-1 in a first direction (as indicated by arrow 461) to the crossflow passage 452. Thereafter, the fluid flows through the crossflow passage 452 into the second standpipe 450-2. Once in the standpipe 450-2, the fluid further flows along and across the second standpipe 450-2 in a second direction opposite to the first direction (as indicated by arrow 463) to the port 454-2 of the second standpipe 450-2. Lastly, the fluid flows through port 454-2 and up through conduit 438-2 out of standpipe 450-2. In the example illustrated, the fluid discharged through port 454-2 flows across filter 428-2 and into fluid chamber 460-2 of pressure regular 440-2. The fluid may then be discharged from fluid chamber 460-2 of pressure regulator 440-2. In one implementation, the fluid is pulled or drawn by a pump or vacuum from fluid chamber 460-2 of pressure regulator 440-2, where it is available for subsequent recirculation through apparatus 220. During such circulation along the path indicated by arrows 459, 461 and 463 fluid is not being ejected by fluid ejection die 422 (or is slowed) such that a majority, if not substantially all, of the fluid flowing through standpipes 450 leaves standpipe 450-2 through port 454-2.

In the example illustrated, system 500 may provide such circulation in a reverse direction compared to that shown in FIG. 10. To provide such a reverse circulation flow, controller 510 causes pump 504-2 to supply fluid from fluid source 502 through internal flow passages and through port 466-2 into fluid chamber 460-1 as indicated by arrows 520. Controller 510 causes pump/inflators 506-1 to disconnect port 479 of compliant chamber 462-1 from atmosphere and to alternatively inflate compliant chamber 462-1 through port 479 to an extent such that valve seat 482 is pivoted out of sealing engagement with crown 480 about port 466-1, opening port 466-1. Controller 510 further outputs control signals causing pump 504-1 to apply a vacuum pressure to pull or draw fluid from fluid chamber 460-1 through the opened port 466-1 and back into fluid source 502, opposite to the direction indicated by arrows 522.

In the reverse flow circulation mode, fluid is directed through and along standpipes 450 in an opposite direction to the direction indicated by arrows 459. In particular, fluid is pumped to or delivered to the standpipe 450-2 from pressure regulator 440-2 and through port 454-2. The fluid then flows along and across the first standpipe 450-2 in a first direction to the crossflow passage 452. Thereafter, the fluid flows through the crossflow passage 452 into the standpipe 450-1. Once in the standpipe 450-1, the fluid further flows along and across the second standpipe 450-1 in a second direction, opposite to the first direction, to the port 454-1 of the standpipe 450-1. Lastly, the fluid flows through port 454-1 out of standpipe 450-1. In the example illustrated, the fluid discharged through port 454-1 flows across filter 228-1 and into fluid chamber 460-1 of pressure regular 440-1. The fluid may then be discharged from fluid chamber 460-1 of pressure regulator 440-1 by being pulled or drawn by a pump or vacuum from fluid chamber 460-1 of pressure regulator 440-1, where it is available for subsequent recirculation through apparatus 420. During such reverse direction fluid circulation, fluid is not being ejected by fluid ejection die 422 such that a majority, if not substantially all, of the fluid flowing through standpipes 450 leaves standpipe 450-1 through port 454-1.

Figure 12:
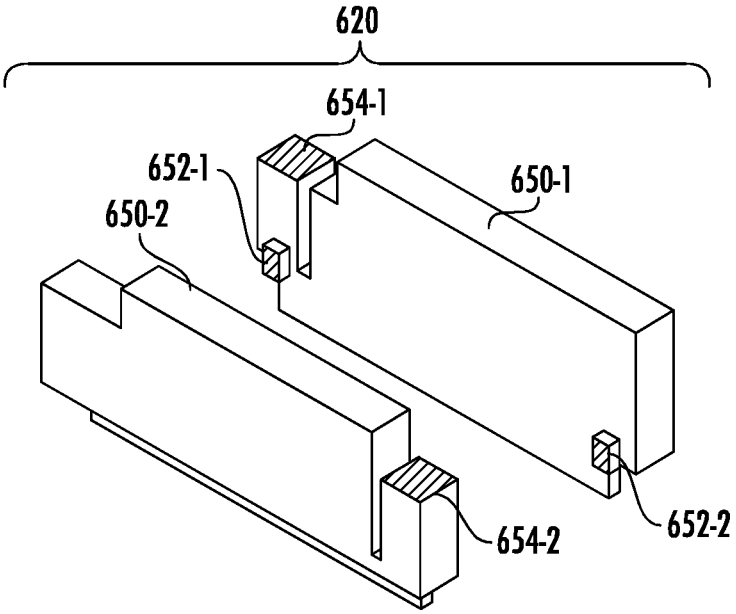
FIG. 12 is an exploded perspective view illustrating portions of an example fluid ejection and circulation apparatus.
Figure 13:
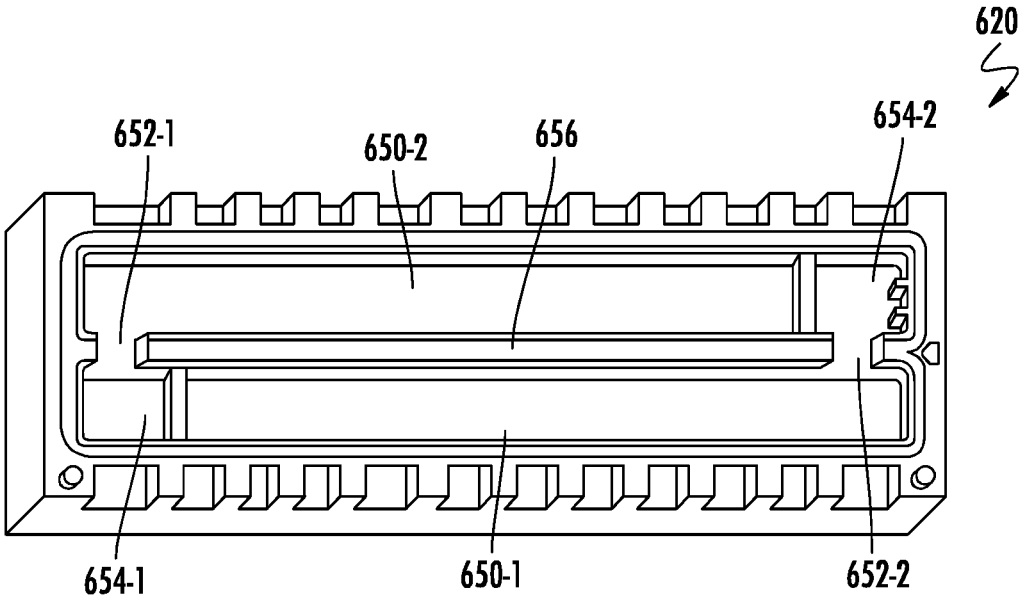
FIG. 13 is a bottom view illustrating portions of the example fluid ejection and circulation apparatus of FIG. 12.

FIGS. 12 and 13 illustrate portions of an example fluid ejection and circulation apparatus 620. FIG. 12 is an exploded view of the two standpipes of apparatus 620. FIG. 13 is a bottom view of the two standpipes of apparatus 620. Apparatus 620 is similar apparatus 420 except that apparatus 620 comprises standpipes 650-1, 650-2 (collectively referred to as standpipe 650), and crossflow passages 652-1, 652-2 in place of standpipes 450-1, 450-2, and crossflow passage 452, respectively, of apparatus 420. Those remaining components of apparatus 620 are similar to the remaining components of apparatus 420 and are shown in FIGS. 5A, 5B and 6-9. Apparatus 620 is similar to apparatus 420 except that apparatus 620 circulates fluid through and across its standpipes in a manner similar to apparatus 320 rather than using a U-turn similar to apparatus 220. Apparatus 620 may be used as part of system 500 (shown in FIG. 10) in place of apparatus 420.

As shown by FIGS. 12 and 13, standpipes 650 extend alongside one another. Standpipe 650-1, 650-2 comprises port 654-1 and 654-2, respectively. Port 654-1 is connected to filter chamber 437-1 (shown in FIGS. 5A and 5B) and is at a first end of standpipe 650-1 proximate a first end of the underlying fluid ejection die 422 (shown in FIGS. 5A and 5B). Port 654-2 is connected to filter chamber 437-2 (shown in FIGS. 5A and 5B) and is at a second opposite end of standpipe 650-1 proximate a second opposite end of the underlying fluid ejection die 422.

Crossflow passages 652 extend through wall 656 (shown in FIG. 13), connecting the interior of standpipe 650-1 to the interior standpipe 650-2. Crossflow passages 652 allow fluid to circulate between and along standpipes 650.

Figure 14:
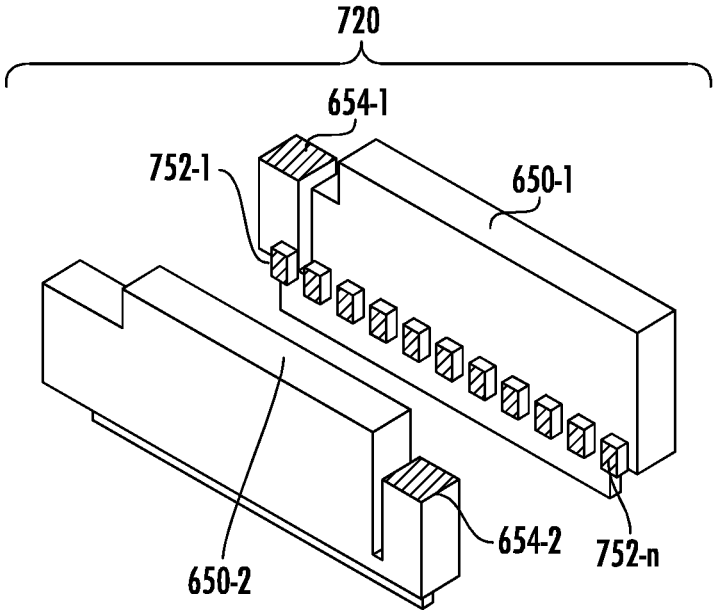
FIG. 14 is an exploded perspective view illustrating portions of an example fluid ejection and circulation apparatus.
Figure 15:
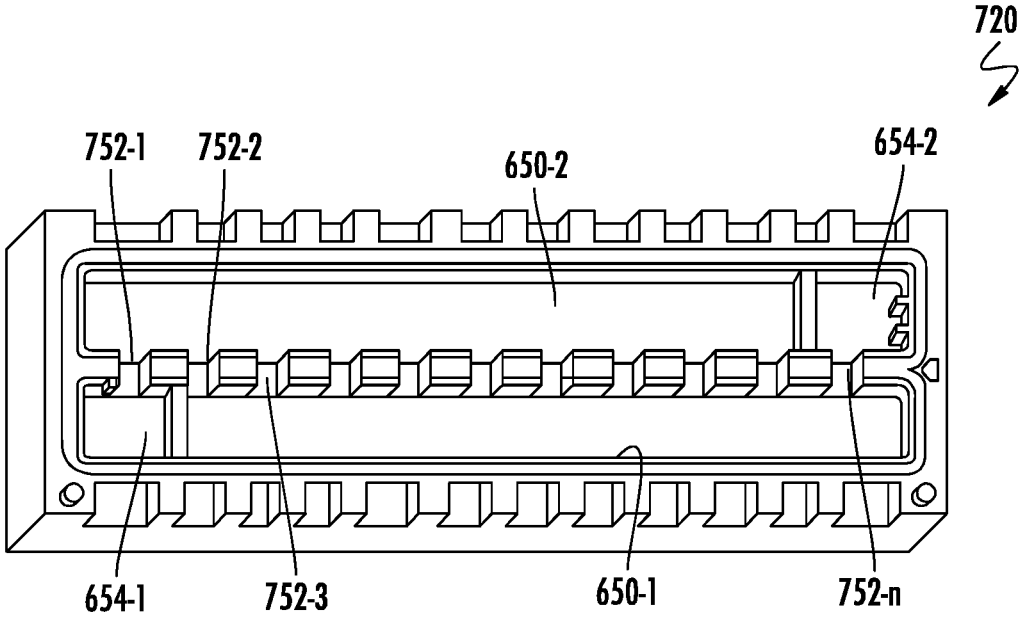
FIG. 15 is a bottom view illustrating portions of the example fluid ejection and circulation apparatus of FIG. 14.

FIGS. 14 and 15 illustrate portions of an example fluid ejection and circulation apparatus 720. FIG. 14 is an exploded view of the two standpipes of apparatus 720. FIG. 15 is a bottom view of the two standpipes of apparatus 720. Apparatus 720 is similar apparatus 620 except that apparatus 720 comprises crossflow passages 752-1-752*n* place of crossflow passages 652. Those remaining components of apparatus 720 are similar to the remaining components of apparatus 420 and are shown in FIGS. 5A, 5B and 6-9. Similar to apparatus 620, apparatus 720 circulates fluid through and across its standpipes in a manner similar to apparatus 320. However, apparatus 720 includes a series of crossflow passages 752 extending in uniformly spaced along the entire length of standpipes 650. As a result, a more uniform flow may be provided. Apparatus 620 may be used as part of system 500 (shown in FIG. 10) in place of apparatus 420.

Figure 16:
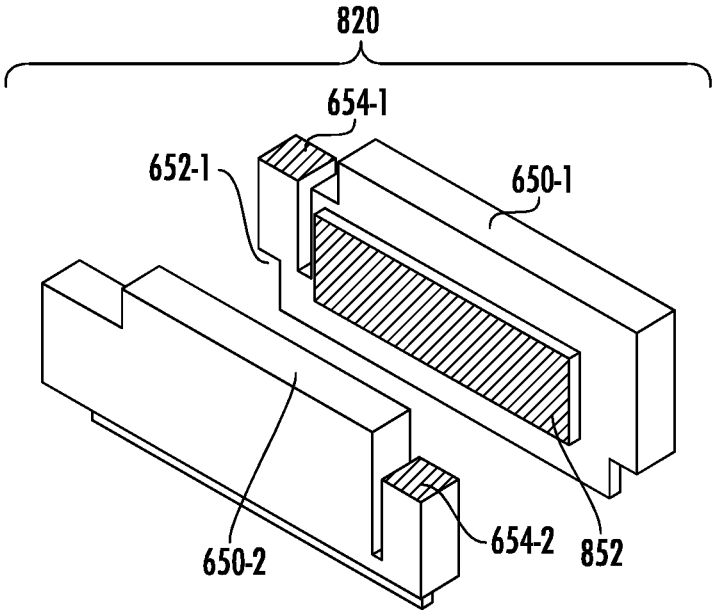
FIG. 16 is an exploded perspective view illustrating portions of an example fluid ejection and circulation apparatus.
Figure 17:
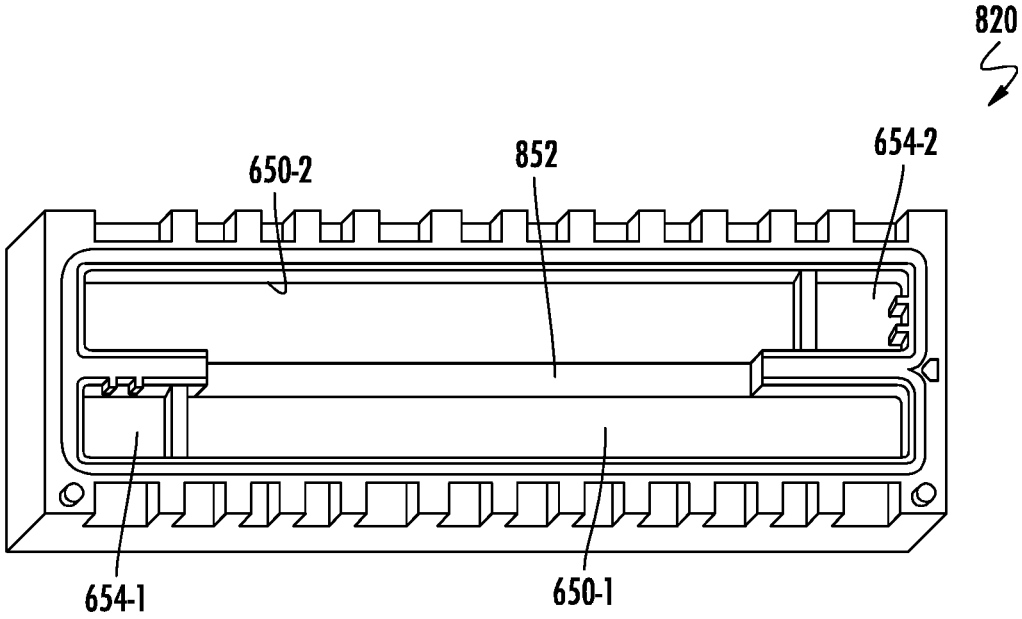
FIG. 17 is a bottom view illustrating portions of the example fluid ejection and circulation apparatus of FIG. 16.

FIGS. 16 and 17 illustrate portions of an example fluid ejection and circulation apparatus 820. FIG. 16 is an exploded view of the two standpipes of apparatus 820. FIG. 17 is a bottom view of the two standpipes of apparatus 820. Apparatus 820 is similar apparatus 620 except that apparatus 820 comprises a single large crossflow passage 852 place of crossflow passages 652. Those remaining components of apparatus 720 are similar to the remaining components of apparatus 420 and are shown in FIGS. 5A, 5B and 6-9. Similar to apparatus 620, apparatus 820 circulates fluid through and across its standpipes in a manner similar to apparatus 320. However, apparatus 820 utilizes a single elongate crossflow passage 852 that extends along substantially the entire length of standpipes 650. As a result, a more uniform flow may be provided. Apparatus 820 may be used as part of system 500 (shown in FIG. 10) in place of apparatus 420.

Figure 18:
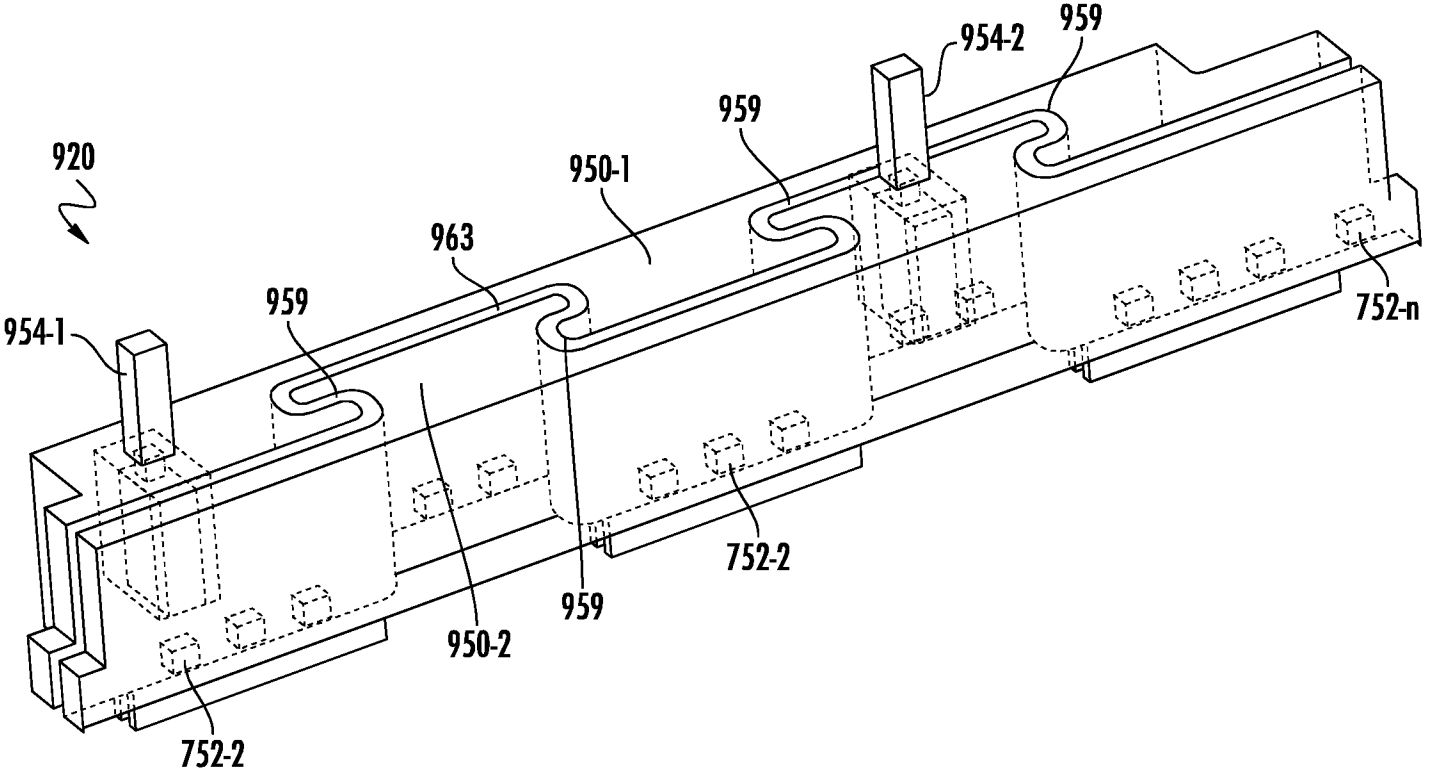
FIG. 18 is a perspective view illustrating portions of an example fluid ejection and circulation apparatus.
Figure 19:
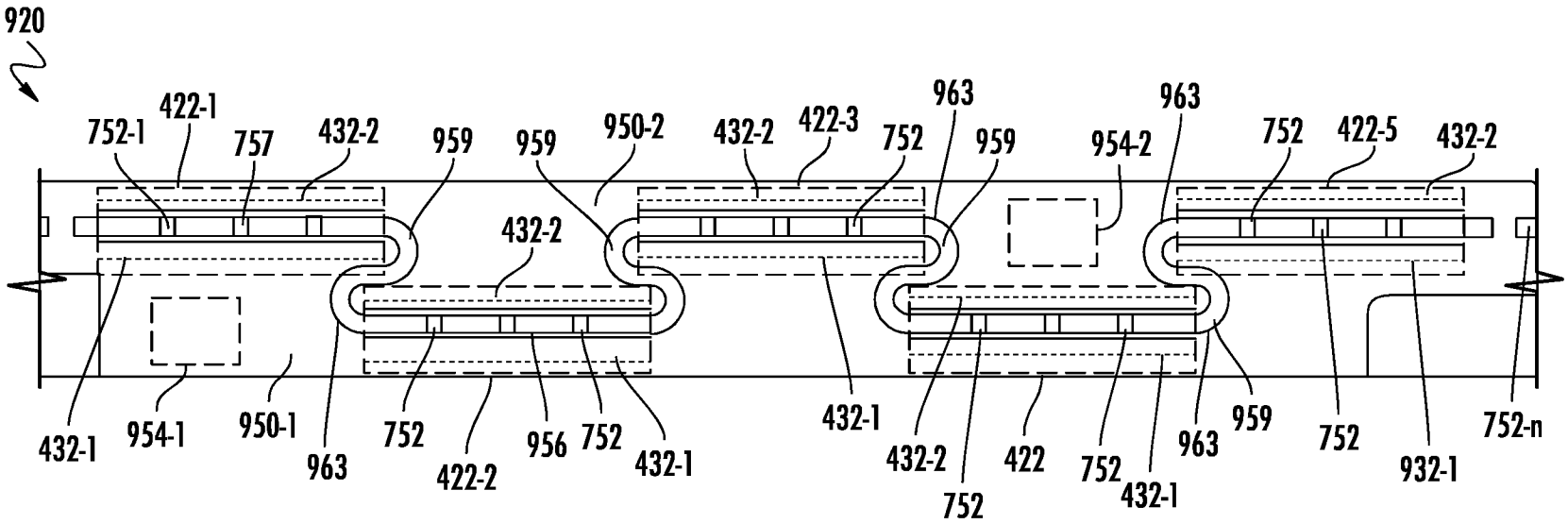
FIG. 19 is a bottom view illustrating portions of the example fluid ejection and circulation apparatus of FIG. 18.

FIGS. 18 and 19 illustrate portions of an example fluid ejection and circulation apparatus 920. FIG. 18 is a perspective view the two standpipes of apparatus 920. FIG. 19 is a bottom view of the two standpipes of apparatus 920, additionally illustrating the relative positions of fluid ejection dies 422 (shown in broken lines) relative to the above standpipes. Apparatus 920 is similar apparatus 720 except that apparatus 920 comprises standpipes 950-1 and 950-2 (collectively referred to as standpipes 950) in place of standpipe 650-1, 650-2 and supports a series of staggered fluid ejection dies 422. Those remaining components of apparatus 920 are similar to the remaining components of apparatus 420 and are shown in FIGS. 5A, 5B and 6-9. Similar to apparatus 720, apparatus 820 circulates fluid through and across its standpipes in a manner similar to apparatus 320. Apparatus 820 may be used as part of system 500 (shown in FIG. 10) in place of apparatus 420.

Standpipes 950-1, 950-2 extend alongside one another. Standpipes 950-1, 950-2 comprises port 954-1 and 954-2, respectively. Port 954-1 is connected to filter chamber 437-1 (shown in FIGS. 5A and 5B) and is proximate a first end of standpipe 950-1 proximate a first end of the intervening wall 956 separating standpipes 950. Port 954-2 is connected to filter chamber 437-2 (shown in FIGS. 5A and 5B) and is at a second opposite end of standpipe 950-1 proximate a second opposite end of the intervening wall 956.

Intervening wall 956 extends along an between standpipes 950 in a serpentine fashion, having a series of S curves 959 that form a series of lobes 963 that alternately project or extend in opposite directions. The S curves along wall 956 and thus formed lobes 963 facilitate the centering of fluid ejection dies 422-1, 422-2, 422-3, 422-4 and 422-5 (collectively referred to as fluid ejection dies 422) in a staggered, but overlapping fashion along standpipes 950 as shown in FIG. 19. For example, fluid ejection die 422-2 is opposite a first of the lobes while fluid ejection die 422-3 is staggered with respect to fluid ejection die 422-2 opposite a second one of the lobes 963.

The overlapping staggering arrangement of dies 422 facilitates fluid ejection across a continuous span. Each of the fluid ejection dies 422 is similar to fluid ejection die 422 described above comprises two fluid delivery passages 432-1, 432-2 in the form of fluid feed slots or fluid feed holes situated on opposite sides of wall 956. For example, fluid delivery passages 432-1 are positioned on a first side of wall 456 opposite to standpipe 950-1 while fluid delivery passages 432-2 are positioned on a second opposite side of wall 456 opposite to standpipe 950-2.

Similar to apparatus 320 and apparatus 720, apparatus 920 includes a series of crossflow passages 752-1 . . . **752-*n* extending through wall 956 and allowing fluid to flow therethrough between standpipes 950. As a result, apparatus 920 provides enhanced fluid circulation to inhibit particle settling. Such circulation may be enhanced when apparatus 920 is in the fluid circulation mode as described above with respect to the other apparatus. Although apparatus 920 is illustrated with the depicted size, spacing and density of crossflow passages 752, in other implementations, apparatus 920 may have other arrangements of crossflow passages 752. In yet other implementations, apparatus 920 may alternatively have ports 954-1 and 954-2 at one end with a crossflow passage at an opposite end to provide U-turn circulation similar to that described above with respect to apparatus 220 and/or apparatus 420**.

Actuation of the above described apparatus between the ejection mode and the circulation mode may be triggered in various manners. For example, in one implementation, actuation to the fluid ejection mode may automatically occur in response to a fluid ejection commander printing command. Actuation to the fluid circulation mode may likewise occur in response to a user input circulation command. In other implementations, actuation to the circulation mode may occur at predetermined or user selected time intervals. In some implementations, time intervals for the triggering or actuation to the fluid circulation mode may be selected based upon the type of fluid being circulated, the age of the fluid being circulated, as well as other characteristics of the apparatus. In some implementations, actuation to the fluid circulation mode may be automatically triggered in response to a sensed sedimentation of particles, a sensed temperature of the fluid within the apparatus or a sensed fluid ejection error or decline in performance. Actuation to the fluid circulation mode may be done by a controller having a processing unit following instruction contained in a non-transitory computer-readable medium, wherein the instructions direct the processing unit to output control signals controlling the pumping or supply of fluid to pressure regulators 40 or from pressure regulators 40.

Although the present disclosure has been described with reference to example implementations, workers skilled in the art will recognize that changes may be made in form and detail without departing from the spirit and scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluid ejection and circulation apparatus comprising:

a fluid ejection die;

a pressure regulator having a fluid chamber;

a first standpipe between the fluid chamber and the fluid ejection die, the first standpipe having a first port above the fluid ejection die and connected to the fluid chamber;

a second standpipe extending alongside the first standpipe, the second standpipe having a second port above the fluid ejection die; and a crossflow passage connecting the first standpipe and the second standpipe, wherein the apparatus is operable in a circulation mode to circulate fluid along a circulation path, the circulation path extending into the first standpipe through the first port, through the crossflow passage into the second standpipe, and out of the second standpipe through the second port.

2. The fluid ejection and circulation apparatus of claim 1, wherein the first port is proximate a first end of the fluid ejection die, wherein the second port is proximate the first end of the fluid ejection die and wherein the crossflow passage is proximate a second end of the fluid ejection die.

3. The fluid ejection and circulation apparatus of claim 2 further comprising an imperforate wall extending between the first standpipe and the second standpipe from the first port to the crossflow passage.

4. The fluid ejection and circulation apparatus of claim 2 further comprising a die carrier having a first fluid passage extending from the first standpipe to the fluid ejection die and a second fluid passage extending from the second standpipe to the fluid ejection die.

5. The fluid ejection and circulation apparatus of claim 2 further comprising a filter and a die carrier between the first standpipe and the fluid ejection die, wherein the first standpipe comprises:

a filter chamber adjacent the filter;

a first conduit extending from the filter chamber to the die carrier; and a second conduit extending from the second port adjacent the die carrier.

6. The fluid ejection and circulation apparatus of claim 2 further comprising a die carrier, the die carrier comprising:

a first face facing the fluid ejection die, a second face opposite the first face; and a recess extending into the second face.

7. The fluid ejection and circulation apparatus of claim 2 further comprising a die carrier between the first standpipe and the fluid ejection die, wherein the fluid ejection die is formed from a first material having a first coefficient of thermal expansion, wherein portions of the first standpipe are formed from a second material having a second coefficient of thermal expansion and wherein the die carrier contacts the portions of the first standpipe and the fluid ejection die, the die carrier being formed from a third material having a third coefficient of thermal expansion between the first coefficient of thermal expansion and the second coefficient of thermal expansion.

8. The fluid ejection and circulation apparatus of claim 1 further comprising a second pressure regulator, wherein the second port of the second standpipe is connected to the second pressure regulator.

9. The fluid ejection and circulation apparatus of claim 1, wherein the first port is proximate a first end of the fluid ejection die and wherein the second port is proximate a second end of the fluid ejection die.

10. The fluid ejection and circulation apparatus of claim 9 further comprising a second crossflow passage connecting the first standpipe and the second standpipe.

11. The fluid ejection and circulation apparatus of claim 10, wherein the crossflow passage is on a first side of a mid-point between the first end and the second end of the fluid ejection die and wherein the second crossflow passage on a second side of the mid-point.

12. The fluid ejection and circulation apparatus of claim 9, wherein the crossflow passage has a length greater than a majority of a length between the first port and the second port.

13. The fluid ejection and circulation apparatus of claim 9, wherein the first standpipe and the second standpipe are separated by an intervening wall forming a series of alternating oppositely extending lobes, wherein the fluid ejection die extends opposite a first one of the lobes and wherein the apparatus further comprises a second fluid ejection die staggered with respect to the fluid ejection die opposite a second one of the lobes.

14. A fluid ejection and circulation apparatus comprising:

a fluid ejection die;

a first pressure regulator comprising a first fluid chamber;

a second pressure regulator comprising a second fluid chamber;

a first standpipe between the first fluid chamber and the fluid ejection die, the first standpipe having a first port connecting the first fluid chamber to the first standpipe proximate a first end of the fluid ejection die;

a second standpipe having a second port connecting the second fluid chamber to the second standpipe proximate the first end of the fluid ejection die;

a crossflow passage connecting the first standpipe and the second standpipe proximate a second end of the fluid ejection die; and an imperforate wall extending between the first standpipe and the second standpipe from the first port to the crossflow passage.

15. The fluid ejection and circulation apparatus of claim 14 further comprising a die carrier having a first fluid passage extending to the fluid ejection die and a second fluid passage extending to the fluid ejection die, wherein the first fluid passage extends between the first standpipe and the die carrier and wherein the second fluid passage extends between the second standpipe and the die carrier.

16. The fluid ejection and circulation apparatus of claim 14, wherein the imperforate wall forms a series of alternating oppositely extending lobes, wherein the fluid ejection die comprises a first fluid ejection die opposite a first one of the lobes and a second fluid ejection die staggered with respect to the first fluid ejection die opposite a second one of the lobes.

17. A method comprising:

supplying fluid from a pressure regulator to a first standpipe opposite a fluid ejection die through a first port of a first standpipe;

circulating the fluid along a first axis within the first standpipe over a first fluid supply slot or a second fluid feed hole leading to a fluid ejection device of the fluid ejection die and from the first standpipe to a second standpipe, along a second axis nonparallel to the first axis, through a crossflow passage connecting the first standpipe and the second standpipe, the second standpipe having a second port; and circulating the fluid along a third axis that is parallel to and alongside the first axis, within the second standpipe over a second fluid supply slot or a second fluid feed hole leading to a second fluid ejection device of the fluid ejection die and to the second port.

18. The method of claim 17 further comprising:

circulating the fluid in a first direction within the first standpipe across the fluid ejection die; and circulating the fluid in a second direction, opposite the first direction, within the second standpipe and across the fluid ejection die to the second port of the second standpipe.

19. The method of claim 17 further comprising circulating the fluid from the second port of the second standpipe through a second pressure regulator.

20. The method of claim 19 further comprising operating a pump to pull fluid out of the second pressure regulator.

* * * * *